US011541435B2

(12) United States Patent
Hollars et al.

(10) Patent No.: US 11,541,435 B2
(45) Date of Patent: Jan. 3, 2023

(54) HAND-HELD DRAIN CLEANER

(71) Applicants: Anthony Hollars, Tucson, AZ (US); Charles Gallo, Pembroke, VA (US)

(72) Inventors: Anthony Hollars, Tucson, AZ (US); Charles Gallo, Pembroke, VA (US)

( * ) Notice: Subject to any disclaimer, the term of this patent is extended or adjusted under 35 U.S.C. 154(b) by 125 days.

(21) Appl. No.: 16/795,579

(22) Filed: Feb. 20, 2020

(65) Prior Publication Data

US 2020/0269289 A1 Aug. 27, 2020

Related U.S. Application Data

(60) Provisional application No. 62/807,997, filed on Feb. 20, 2019.

(51) Int. Cl.

| | |
|---|---|
| ***B08B 9/032*** | (2006.01) |
| ***B08B 5/02*** | (2006.01) |
| ***E03C 1/304*** | (2006.01) |
| *F24F 13/22* | (2006.01) |
| *B08B 5/00* | (2006.01) |

(52) U.S. Cl.

CPC ..... *B08B 9/0328* (2013.01); *B08B 5/02* (2013.01); *E03C 1/304* (2013.01); *B08B 5/00* (2013.01); *B08B 2209/032* (2013.01); *F24F 13/222* (2013.01); *F24F 2221/22* (2013.01)

(58) Field of Classification Search

CPC ..... B08B 9/0238; B08B 5/02; E03C 1/304

See application file for complete search history.

(56) References Cited

U.S. PATENT DOCUMENTS

| | | | | |
|---|---|---|---|---|
| 5,590,696 | A * | 1/1997 | Phillips | F17C 7/00 222/3 |
| 5,996,597 | A * | 12/1999 | Gallo | B08B 9/0321 134/169 C |
| 10,744,525 | B1 * | 8/2020 | Logan | B05B 12/1409 |
| 2003/0028957 | A1 * | 2/2003 | Kawai | E03C 1/304 4/255.01 |
| 2005/0230434 | A1 * | 10/2005 | Campbell | B05C 17/0146 222/389 |
| 2010/0132101 | A1 * | 6/2010 | Bates | E03C 1/304 4/255.04 |
| 2011/0016658 | A1 * | 1/2011 | Xia | E03C 1/304 15/344 |
| 2015/0232317 | A1 * | 8/2015 | Donohue | B08B 5/02 15/406 |

* cited by examiner

*Primary Examiner* — Joseph L. Perrin
*Assistant Examiner* — Kevin G Lee
(74) *Attorney, Agent, or Firm* — Dale Regelman

(57) ABSTRACT

A hand-held drain cleaning apparatus which includes a control housing comprising an upper body portion and a lower body portion, a release valve member being movable between at least a first position wherein the release valve member prevents fluid from flowing into a first fluid passageway from a second fluid passageway, and a second position wherein fluid can flow from the second fluid passageway and into the first fluid passageway. The hand-held drain cleaning apparatus further includes a flexible, tubular member having first and second end portions, and a terminal discharge member in fluid communication with the second end portion of the tubular member.

10 Claims, 3 Drawing Sheets

HAND-HELD DRAIN CLEANER

CROSS-REFERENCE TO RELATED APPLICATIONS

This Application claims priority from a United States Provisional Patent Application filed on Feb. 20, 2019 and having Ser. No. 62/807,997.

FIELD OF THE DISCLOSURE

Disclosed is a portable drain cleaning apparatus that is particularly adapted for use in cleaning condensation drains associated with air conditioning and other refrigeration units, but which could also be used in other plumbing applications.

DESCRIPTION OF THE RELATED ART

Over the years numerous devices has been utilized in connection with the clearing of clogged drains. For example, it has heretofore been known to attach one end of a hose to a sink faucet and to place the other end of the hose, in a generally sealed manner, within a clogged drain in order to cause pressurized water to flow through the hose once the faucet is opened in an attempt to remove any obstructions.

Unfortunately, such a simple arrangement rarely works, even on drains having relatively minor obstructions therein. In an attempt to enhance such a known system, it has also been proposed to place a container housing a drain cleaning fluid in series with the hose in order to introduce an additional cleaning enhancing substance within the clogged drain. This known prior art arrangement generally has associated therewith a level of effectiveness commensurate with simply pouring the cleaning enhancing substance directly down the drain.

Various other drain cleaning devices have also been proposed which incorporate auxiliary pressure sources. For instance, it is known to utilize a miniature gas cartridge in combination with a plunger-type drain cleaning unit to create a high pressure force to dislodge an obstruction within a drain. Actually, standard plunger-type drain cleaning units are essentially just as effective on almost all clogs experienced in these particular types of drains. In addition, such known arrangements are only useful in limited applications due to their size and overall configuration. In essence, these known arrangements are only functional in cleaning standard sink drains and toilets.

One particular environment wherein such prior art arrangements are not functional is in cleaning condensate drains. The main reason why these prior art arrangements are not utilized in connection with condensation drain clogs is the inaccessibility of condensate drains in general. Usually such drains are located in confined areas in attics or basements and the inlet openings thereto are often located directly adjacent a cooling coil or other structure which provides for extremely limited access.

Because of these and other shortcomings of prior known systems, until just recently, the most common method for cleaning condensation drains, particularly in air conditioning or other types of refrigeration units, has been to force a flow of Freon from a pressurized container through the clogged drain. However, with the enactment of regulations by the Environmental Protection Agency (EPA), the use of Freon-based cleaning systems has been made illegal.

In the aftermath of these regulation changes, it became common to simply utilize a rather large, pressurized air or nitrogen tank having an attached hose, the free end of which can be positioned at the opening of a condensate drain conduit such that opening of a valve on the tank will force pressurized gas to be injected into the conduit. However, as indicated above, such drain conduits are often found in confined areas and the lugging of these heavy tanks is not only extremely inconvenient but sometimes dangerous. In addition, it is extremely difficult, if not impossible, to regulate or determine the exact amount of pressurized gas that is released in any given application such that the customer is generally charged for a greater percentage of the pressurized gas than is actually dispensed. In view of the above, it has also been previously proposed, such as disclosed in U.S. Pat. Nos. 5,803,101 and 5,996,597 which are incorporated herein by reference, to provide a drain cleaning apparatus that is compact and lightweight so as to be readily portable, designed to be easily maneuvered so it can be used in various plumbing environments and particularly in cleaning hard to access condensate drain conduits, which cost effective to make and utilize, and consumer conscious in nature. Still, there exists a need in the art for improvements to such known portable drain cleaning apparatuses. In particular, there exists a need to provide a very compact, single hand operational drain cleaning apparatus which is simple in construction, yet durable so as to have a long service life.

SUMMARY

A first embodiment of a hand-held drain cleaning apparatus is disclosed. The hand-held drain cleaning apparatus includes a control housing comprising an upper body portion and a lower body portion, a first end, and a second end, and configured to be grasped by and held in a user's hand, the control housing being formed to include a first fluid passageway extending through the upper body portion from the first end to the second end, a second fluid passageway formed in the lower body portion, the second fluid passageway having a first end in fluid communication with a threaded aperture disposed on an exterior surface of the lower body portion and a second end in fluid communication with the first fluid passageway.

The hand-held drain cleaning apparatus further includes a release valve member having a first portion slidingly disposed within the first fluid passageway and a second portion extending outwardly from the first end, the release valve member being movable between at least a first position wherein the release valve member prevents fluid from flowing into the first fluid passageway from the second fluid passageway, and a second position wherein fluid can flow from the second fluid passageway and into the first fluid passageway.

The hand-held drain cleaning apparatus further includes a flexible, tubular member having first and second end portions, the first end portion of the tubular member being attached to the second end of the control housing, downstream of the release valve member, with an interior of the tubular member opening into the first fluid passageway.

The hand-held drain cleaning apparatus further includes a terminal discharge member in fluid communication with the second end portion of the tubular member, the terminal discharge member being adapted to be sealingly engaged with an open end of a drain conduit and including an outlet opening in fluid communication with the fluid passage through the lumen.

The hand-held drain cleaning apparatus further includes a compressed gas cartridge, sized to substantially fit in the palm of a user's hand, wherein placement of the terminal discharge member at the open end of a drain conduit and movement of the release valve member from the spring-biased first position to the second position causes pressurized gas from the compressed gas cartridge to flow into and through the control housing, the tubular member, the terminal discharge member, and into the drain conduit in order to clean the drain conduit.

A method using the first embodiment of Applicants' hand-held drain cleaning apparatus is disclosed. The method includes attaching a compressed gas cartridge to the threaded aperture on the lower body portion of the hand-held drain cleaning apparatus, sealingly disposing the terminal discharge member into the clogged drain, manually pushing the second portion of the release valve member inwardly to move the release valve member from the first position to the second position; and directing a flow of pressuring fluid from the hand-held drain cleaning apparatus and into the clogged drain.

A second embodiment of Applicants' hand-held drain cleaning apparatus is disclosed, the second embodiment including a control housing comprising an upper body portion and a lower body portion, a first end, and a second end, and configured to be grasped by and held in a user's hand, the control housing being formed to include a first fluid passageway extending through the upper body portion from the first end to the second end, a second fluid passageway formed in the lower body portion, the second fluid passageway having a first end in fluid communication with a threaded aperture disposed on an exterior surface of the lower body portion and a second end in fluid communication with the first fluid passageway.

The second embodiment of Applicants' hand-held drain cleaning apparatus further includes a release valve member having a second portion slidingly disposed within the first fluid passageway and a first portion extending outwardly from the second end, the release valve member being movable between at least a first position wherein the release valve member prevents fluid from flowing into the first fluid passageway from the second fluid passageway, and a second position wherein fluid can flow from the second fluid passageway and into the first fluid passageway.

The second embodiment of Applicants' hand-held drain cleaning apparatus further includes a pull release member comprising a threaded connector disposed on a distal end of the first portion of the first portion of the release valve member and opposing cantilevered arms, wherein a first portion of the threaded connector interconnects a distal end of the first portion of the release valve member.

The second embodiment of Applicants' hand-held drain cleaning apparatus further includes a flexible, tubular member having first and second end portions, the first end portion of the tubular member being attached to a second portion of the threaded connector of the control housing, downstream of the release valve member, with an interior of the tubular member opening into the first fluid passageway.

The second embodiment of Applicants' hand-held drain cleaning apparatus further includes a terminal discharge member in fluid communication with the second end portion of the tubular member, the terminal discharge member being adapted to be sealingly engaged with an open end of a drain conduit and including an outlet opening in fluid communication with the fluid passage through the lumen.

The second embodiment of Applicants' hand-held drain cleaning apparatus further includes a compressed gas cartridge, sized to substantially fit in the palm of a user's hand, wherein placement of the terminal discharge member at the open end of a drain conduit and movement of the release valve member from the spring-biased first position to the second position causes pressurized gas from the compressed gas cartridge to flow into and through the control housing, the tubular member, the terminal discharge member, and into the drain conduit in order to clean the drain conduit.

A method using the second embodiment of Applicant's hand-held drain cleaning apparatus is disclosed. The method includes attaching a compressed gas cartridge to the threaded aperture on the lower body portion of the hand-held drain cleaning apparatus, sealingly disposing the terminal discharge member into the clogged drain, manually pulling the pull release member backwardly to move the release valve member from the first position to the second position; and directing a flow of pressuring fluid from the hand-held drain cleaning apparatus and into the clogged drain Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Applicant's hand-held drain cleaner is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of Applicant's disclosure may be combined in any suitable manner in one or more embodiments. In the following description, numerous specific details are recited to provide a thorough understanding of embodiments of the invention. One skilled in the relevant art will recognize, however, that Applicant's disclosure may be practiced without one or more of the specific details, or with other methods, components, materials, and so forth. In other instances, well-known structures, materials, or operations are not shown or described in detail to avoid obscuring aspects of Applicant's disclosure, and it will be appreciated by those skilled in the art that it is intended to cover alternatives, modifications, and equivalents as may be included within the spirit and scope of Applicant's disclosure as defined by the appended claims and their equivalents as supported by the following disclosure and drawings.

Figure 1:
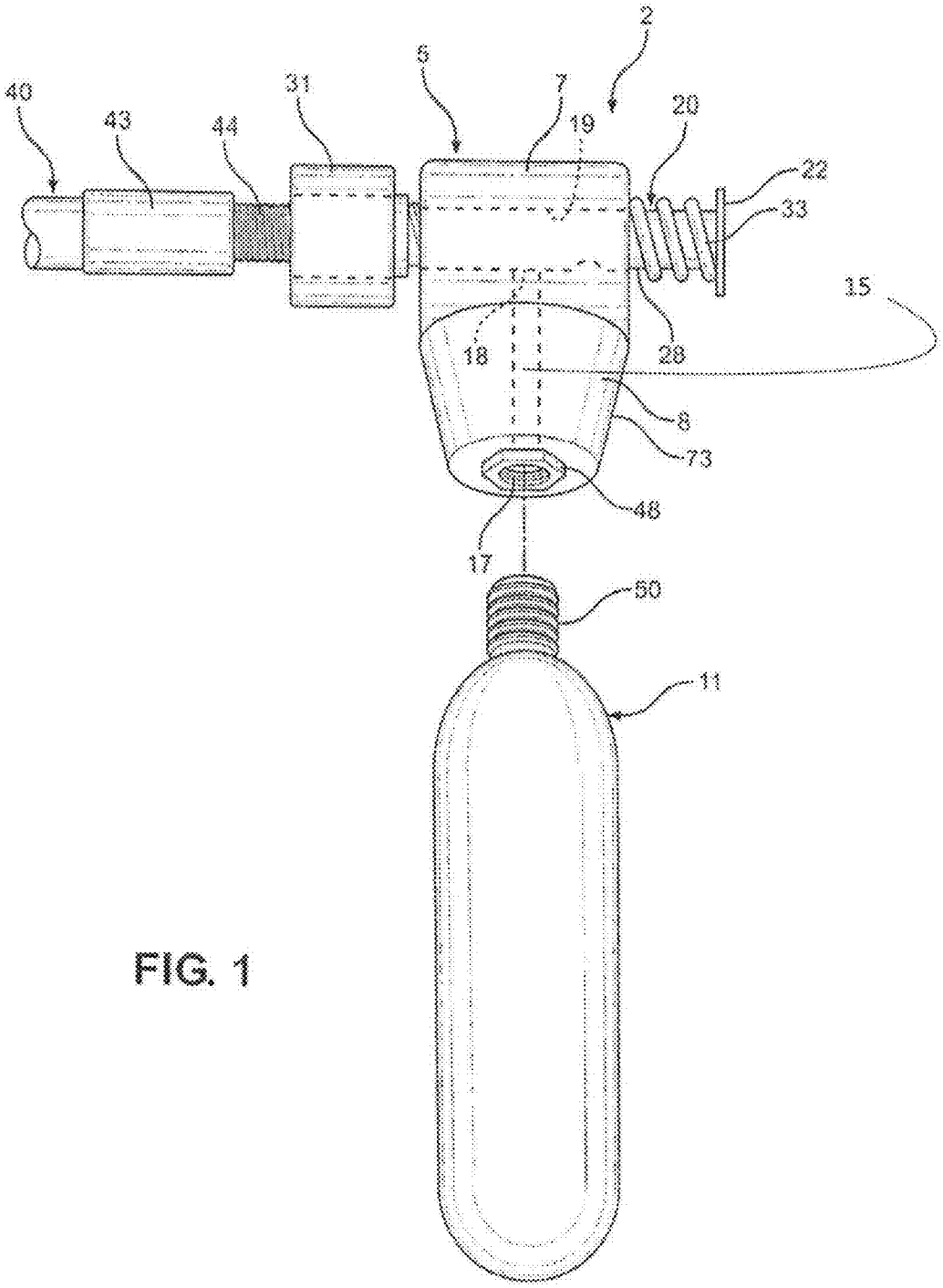
FIG. 1 is a partial exploded view of a drain cleaning apparatus constructed in accordance with a first preferred embodiment of the invention.

With initial reference to FIG. 1, the drain cleaning apparatus constructed in accordance with a first preferred embodiment of the invention is generally indicated at 2 and includes a control housing 5, which can be made from various materials but is preferably formed of metal for durability and serviceability. Control housing 5 includes an upper body portion 7 and a lower body portion 8. As will be detailed below, drain cleaning apparatus 2 is used in combination with a pressurized cartridge generally indicated at 11.

Lower body portion 8 formed with an internal fluid passage 15 having an inlet section 17 leading to an open terminal end 18 exposed to a through bore 19 formed in upper body portion 7. A release valve unit, generally indicated at 20, includes a push button release member 22 attached to a linear valve element 28 which projects through bore 19. At an end of linear valve element 28, opposite push button release member 22, an internally threaded connector or coupling 31 is provided. In addition, as shown, a coil spring 33 is wound around a portion of linear valve element 28. More specifically, coil spring 33 extends between upper body portion 7 and push button release member 22 so as to bias push button release member 22 away from upper body portion 7, i.e., bias linear valve element 28 to the right as shown in FIG. 1.

Internally threaded connector 31 may include a knurled outer surface to assist in connecting to a tubular member 40. In general, tubular member 40 is defined by a flexible tube or hose preferably provided with a terminal discharge member (not shown) for sealing against a conduit drain such as disclosed in U.S. Pat. Nos. 5,803,101 and 5,996,597 which are incorporated herein by reference. In any case, tubular member 40 is shown to include a fitting, preferably made of brass, that includes a crimped sleeve portion 43 and an externally threaded end 44. End 44 is adapted to be threadably secured to connector 31 when the added length and flexibility afforded by tubular member 40 is desired. With this construction, connector 31 enables flexible tubular member 40 to be more easily maneuvered without developing a kink during use of the drain cleaning apparatus. Again, this can be particularly important given the working environment for this apparatus. On the other hand, a terminal discharge member (not shown) designed for the conduit to be cleaned could be directly attached to connector 31 such that flexible tubular member 40 is optional.

The lower body portion 8 of control housing 5 is provided with a fitting 48 which is internally threaded at inlet section 17. Correspondingly, pressurized cartridge 11 is externally threaded at an upper tip portion 50 in order to removably secure cartridge 11 to control housing 5. Upon threading cartridge 11 to lower body portion 8, tip portion 50 is simultaneously punctured within lower body portion 8 in a manner known in the art so that the pressurized fluid in cartridge 11 is in fluid communication with internal fluid passage 15. Cartridge 11 is itself preferably made of metal, although polymer materials could also be used, and has a relatively thin outer wall. As indicated above, cartridge 11 is pressurized, i.e., pre-charged with a gaseous medium. The particular charging pressure could vary in accordance with the particular compressed gas of use but, in certain embodiments, cartridge 11 is pre-charged with pressurized gas between about 500 psi and about 1,000 psi, based upon the compressed gas utilized.

In certain embodiments, cartridge 11 contains carbon dioxide having a pressure between about 500 psi and about 1,000 psi, based upon the compressed gas utilized.

In certain embodiments, cartridge 11 may contain, in addition to the gaseous medium which could be carbon dioxide for example, a drain cleaning or algaecide substance. Preferably, the drain cleaning or algaecide would be in liquid form and would be atomized so as to be entrained within the gaseous medium in a manner analogous to pre-charged perfume spray containers. The presence of drain cleaning or algaecide substance will assure that the clogged drain is not only cleared but is treated against future occurrences.

Figure 2:
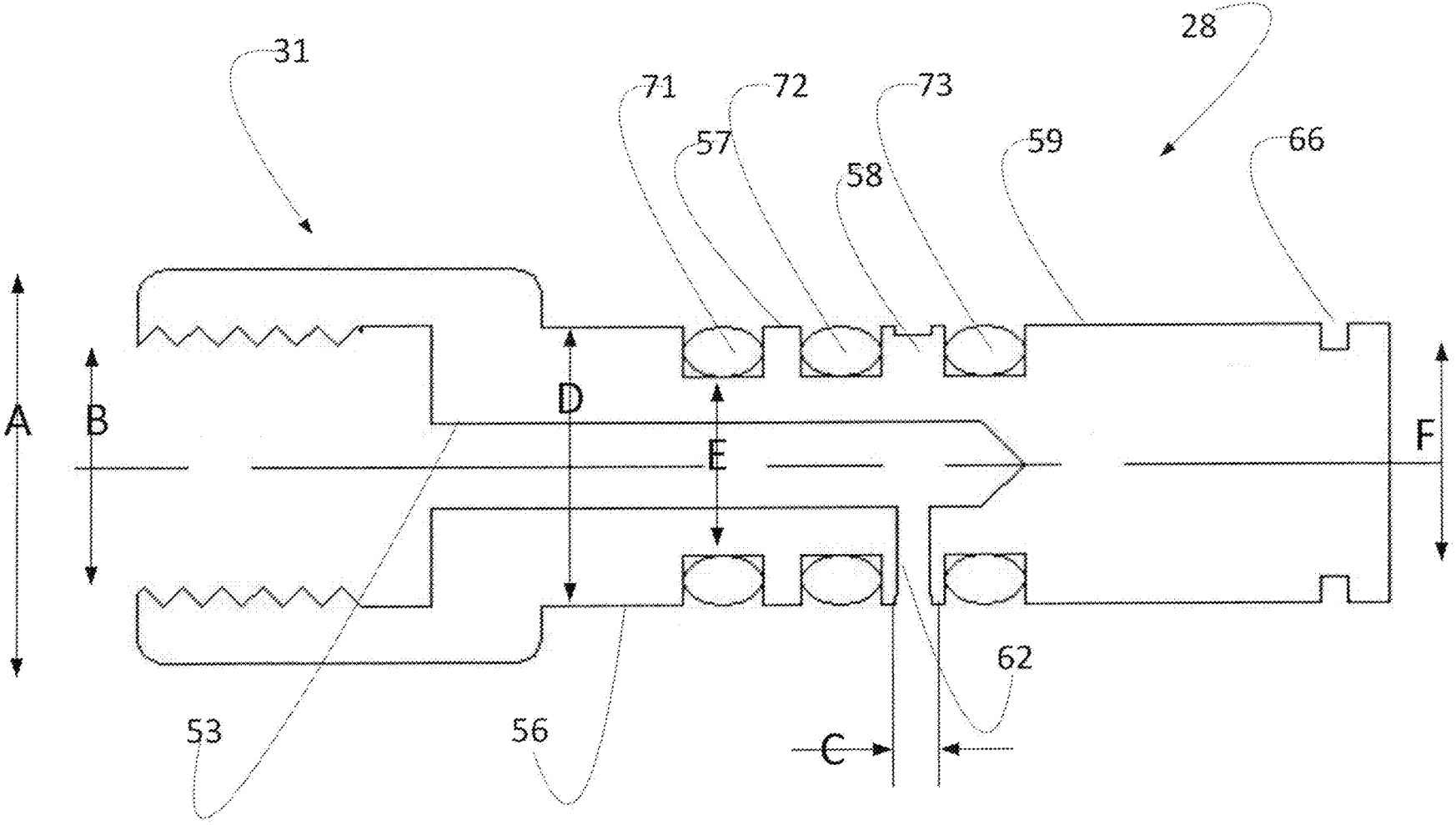
FIG. 2 is a schematic view of a valve element of the drain cleaning apparatus of FIG. 1.

One embodiment of linear valve element 28 is illustrated in FIG. 2. As shown in this exemplary embodiment, linear valve element 28 takes the form of a linear-slidable spool valve formed to include an internally-threaded connector 31 extending inwardly from a second end of linear valve element 28, and various lands 56-59. Internally-threaded connector 31 is in fluid communication with passageway 53. Land 58 has formed therein an inlet 62 which is open to internal passage 53. Internal passage 53 is open to connector 31 and, correspondingly, hose 40.

Linear valve element 28 further comprises three (3) O-rings. A first O-ring 71 is disposed within an annular groove defined partially by a first side of land 57. A second O-ring 72 is disposed within an annular groove defined partially by a second side of land 57 and a first side of land 58. A third O-ring 73 is disposed within an annular groove defined partially by a second side of land 57 and land 59.

In the illustrated embodiment of FIG. 2, none of O-rings 71, 72, or 73, blocks inlet port 62. Therefore, in the illustrated embodiment of FIG. 2, compressed gas can flow through inlet 62 and through passageway 53. On the other hand, if linear valve element 28 is moved to the left, then either O-ring 71 or O-ring 72 blocks flow into inlet 62. Similarly, if linear valve element is manually moved to the right, then O-ring 73 blocks flow into inlet 62. The movement of linear valve element 28 is manually controlled using push button release member 22.

FIG. 1 illustrates push button release member 22 in an extended position remote from upper body portion 7 due to the biasing of spring 33, inlet 62 is not aligned with terminal end 18 of internal fluid passage 15. As also shown, land 59 includes an annular cutout or groove 66 at which push button release member 22 is mounted.

For the sake of completeness and to provide a better understanding of the compact nature of drain cleaning apparatus 2, in certain embodiments the outer diameter A of connector 31 is about 0.450 inches, while in certain embodiments the internal diameter B at the threads of connector 31 is about 0.312 inches for an internal threaded length of about 0.250 inches. In certain embodiments the diameter C of inlet 62 is about 0.040 inches, while in certain embodiments the diameter D of each of lands 56-59 are about 0.310 inches, the diameter E between lands 56-59 in certain embodiments being about 0.200 inches and with annular groove or cutout 66 in certain embodiments having a diameter F of about 0.250 inches and a width of about 0.030 inches. Finally, in certain embodiments internal passage 53 has a diameter of about 0.094 inches. One of ordinary skill in the art will appreciate that these dimensions are representative only and can vary without departing from the invention as exemplified the "about" or which in certain embodiments carry a 10% variation.

In any case, when drain cleaning apparatus 2 is in the configuration shown in FIG. 1 and a pressurized cartridge 11 is threaded onto lower section 48 of lower body portion 8, an O-ring (not shown) provided within control housing 5 adjacent inlet 17 seals against cartridge 11 and a puncture member (also located within control housing 5 adjacent inlet 17) pierces cartridge 11. At this point, drain cleaning apparatus 2 is ready for use.

During use, control housing 5 and cartridge housing 11 are adapted to be readily grasped by and held in one hand for operation purposes. To aid in grasping drain cleaning apparatus 2, in certain embodiments lower body portion 8 is advantageously formed with a concave finger support section 73 (FIG. 1). That is, a user can wrap an index finger about concave finger support section 73 and three other fingers about cartridge 11 to readily grasp drain cleaning apparatus 2 for use. Once properly positioned for use, the thumb of a user will be positioned at push button release member 22 and the user need merely push on release member 22 to cause valve element 28 to slide linearly against the biasing force of spring 33 so that pressurized fluid will flow from cartridge 11 through fluid passage 15, internal passage 53 and into tubular member 40.

With the above in mind, it should be clear that drain cleaning apparatus 2 is quite compact, with the entire structure basically conveniently fitting in the palm of the user's hand. The small size makes the tool ideal for the confined spaces in which it would most often be used. In the most preferred forms of the invention, at least control housing 5 and linear valve element 28 are formed of metal so as to be durable, even in the main field of use. The overall tool can be used with a variety of terminal end nozzles or fitments, thereby making the product quite versatile. The operation is simple, yet advanced, at least in that there are no rotating valves (ball valves or otherwise). The overall tool is designed for a long service life, but is also readily serviceable if any rebuilding is needed.

Figure 3:
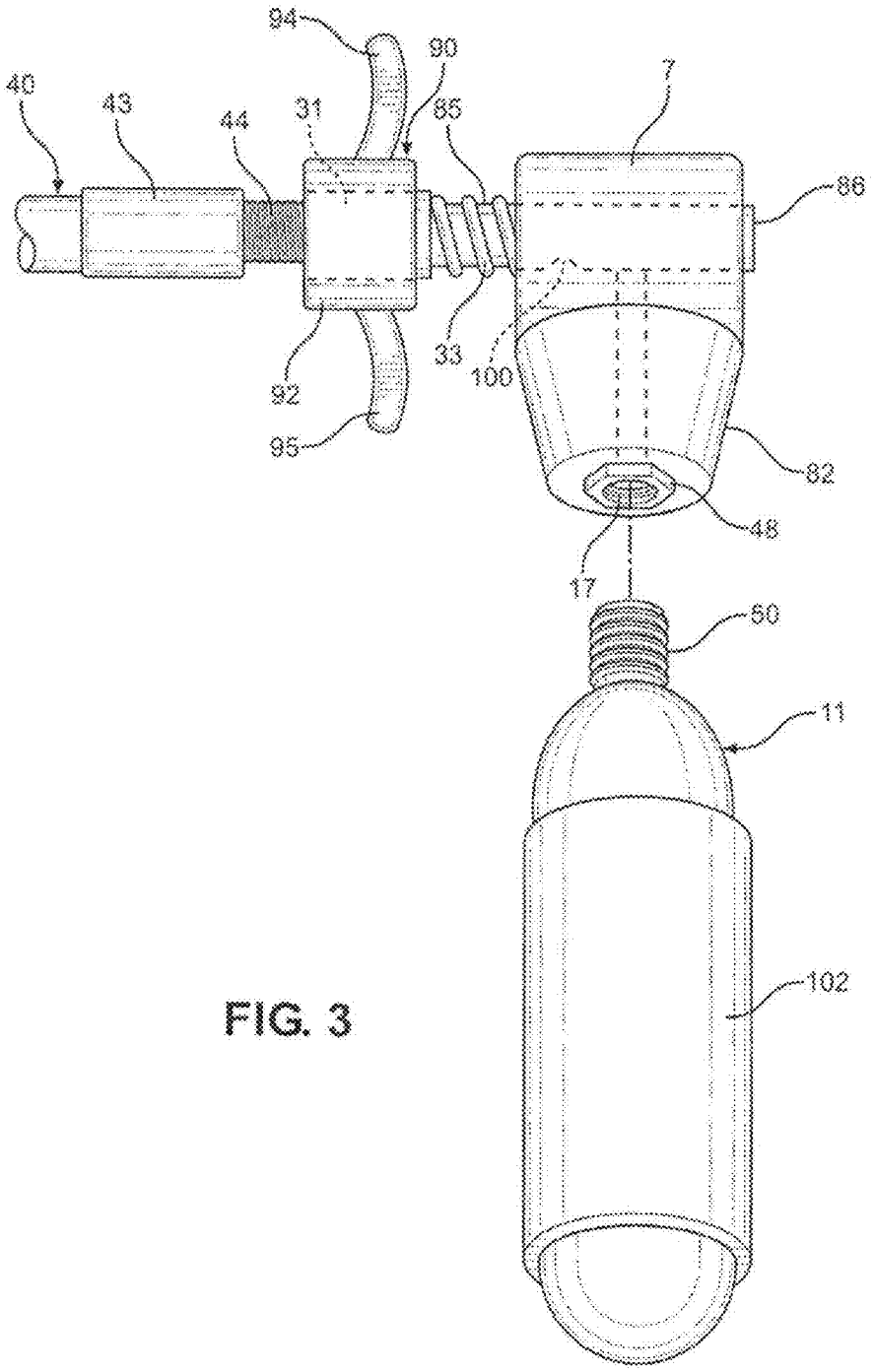
FIG. 3 is a partial exploded view of a drain cleaning apparatus constructed in accordance with a second preferred embodiment of the invention.

Certainly, there are various different constructions which can be established to achieve the objects of the invention. By way of example, FIG. 3 illustrates a second embodiment of Applicants' disclosure wherein a pull-type actuation is employed instead of the push-type actuation of the first embodiment.

Basically, the main differences with the first embodiment include the shape of the lower body portion 82 which is changed as it does not need to be concave. In addition, land 59 of a linear valve element 85 is provided with a stop member in the form of a C-clip 86 at cut-out or groove 66. In addition, this embodiment includes a pull release member 90 having a central body 92 mounted about connector 31, such as through a friction fit, and opposing cantilevered arms 94 and 95.

Finally, in this embodiment, spring 33 is repositioned between upper body portion 7 and connector 31 or pull release member 90. In this manner, linear valve element 85 is biased leftward as shown in FIG. 2, wherein an inlet 100 of linear valve element 85 does not align with internal fluid passage 15. However, during use with a pressurized cartridge 11, this drain cleaning apparatus can also be held in the palm of a user's hand with, for instance, index and middle fingers of the user extending about arms 94 and 95 respectively. When it is desired to direct pressurized fluid from cartridge 11 to tube 40, the user need only pull on arms 94 and 95 to linearly shift valve element 85 against the biasing force of spring 33. For additional comfort or for gripping purposes, a sleeve 102, which could be soft, cushioned, tacky, textured or the like, may be provided about cartridge 11.

While the preferred embodiments of the present disclosure have been illustrated in detail, it should be apparent that modifications and adaptations to those embodiments may occur to one skilled in the art without departing from the scope of Applicant's disclosure.

We claim:

1. A hand-held drain cleaning apparatus comprising:

a control housing comprising an upper body portion and a lower body portion, a first end, and a second end, and configured to be grasped by and held in a user's hand, said control housing being formed to include a first fluid passageway extending through said upper body portion from the first end to the second end, a second fluid passageway formed in said lower body portion, said second fluid passageway having a first end in fluid communication with a threaded aperture disposed on an exterior surface of said lower body portion and a second end in fluid communication with said first fluid passageway;

a release valve member having a first portion slidingly disposed within said first fluid passageway and a second portion extending outwardly from said first end, a push button formed on a distal end of said second portion of said release valve member, said first portion of said release valve member being movable between at least a first position wherein said release valve member prevents fluid from flowing into said first fluid passageway from said second fluid passageway, and a second position wherein fluid can flow from said second fluid passageway and into said first fluid passageway;

a spring extending wound extending between said first end and said push button, wherein said spring biases said first release valve member in said first position;

a flexible, tubular member having a first end portion and a second end portion, wherein the first end portion of said tubular member being attached to said second end of said control housing, downstream of said release valve member, with an interior of said tubular member opening into said first fluid passageway;

a terminal discharge member in fluid communication with the second end portion of said tubular member, said terminal discharge member being adapted to be sealingly engaged with an open end of a drain conduit and including an outlet opening in fluid communication with said first fluid passageway through said lumen; and a compressed gas cartridge, sized to substantially fit in the palm of the user's hand, wherein placement of said terminal discharge member at the open end of the drain conduit and movement of said release valve member from said spring-biased first position to said second position causes pressurized gas from said compressed gas cartridge to flow into and through said control housing, said tubular member, said terminal discharge member, and into the drain conduit in order to clean the drain conduit.

2. The hand-held drain cleaning apparatus according to claim 1, said lower body portion further comprising a puncture member adapted to puncture said compressed gas cartridge when said cartridge housing is secured to threaded aperture.

3. The hand-held drain cleaning apparatus according to claim 1, wherein said compressed gas cartridge contains at least one of a drain cleaning fluid and an algaecide.

4. The hand-held drain cleaning apparatus according to claim 1, further comprising a coil spring disposed around said second portion of said release valve member biasing said release valve member in said first, i.e. closed, position.

5. The drain cleaning apparatus according to claim 1, wherein said terminal discharge member comprises a generally, conically-shaped terminal end portion.

6. A hand-held drain cleaning apparatus comprising:

a control housing comprising an upper body portion and a lower body portion, a first end, and a second end, and configured to be grasped by and held in a user's hand, said control housing being formed to include a first fluid passageway extending through said upper body portion from the first end to the second end, a second fluid passageway formed in said lower body portion, said second fluid passageway having a first end in fluid communication with a threaded aperture disposed on an exterior surface of said lower body portion and a second end in fluid communication with said first fluid passageway;

a release valve member having a first portion slidingly disposed within said first fluid passageway and a second portion extending outwardly from said first end, a push button formed on a distal end of said second portion of said release valve member, said first portion of said release valve member being movable between at least a first position wherein said release valve member prevents fluid from flowing into said first fluid passageway from said second fluid passageway, and a second position wherein fluid can flow from said second fluid passageway and into said first fluid passageway;

a spring extending between said first end and said push button, wherein said spring biases said first release valve member in said first position;

a pull release member comprising a threaded connector disposed on a distal end of said first portion of said first portion of said release valve member and opposing cantilevered arms, wherein a first portion of said threaded connector interconnects a distal end of said first portion of said release valve member;

a flexible, tubular member having a first end portion and a second end portion, wherein the first end portion of said tubular member being attached to said second end of said control housing, downstream of said release valve member, with an interior of said tubular member opening into said first fluid passageway; and a terminal discharge member in fluid communication with the second end portion of said tubular member, said terminal discharge member being adapted to be sealingly engaged with an open end of a drain conduit and including an outlet opening in fluid communication with said first fluid passageway through said lumen; and a compressed gas cartridge, sized to substantially fit in the palm of the user's hand, wherein placement of said terminal discharge member at the open end of the drain conduit and movement of said release valve member from said spring-biased first position to said second position causes pressurized gas from said compressed gas cartridge to flow into and through said control housing, said tubular member, said terminal discharge member, and into the drain conduit in order to clean the drain conduit.

7. The hand-held drain cleaning apparatus according to claim 6, said lower body portion further comprising a puncture member adapted to puncture said compressed gas cartridge when said cartridge housing is secured to threaded aperture.

8. The hand-held drain cleaning apparatus according to claim 7, wherein said compressed gas cartridge contains at least one of a drain cleaning fluid and an algaecide.

9. The hand-held drain cleaning apparatus according to claim 8, further comprising:

a coil spring disposed around said first portion of said release valve between said connector and said second end of said upper body portion biasing said release valve member in said first, i.e. closed, position.

10. The drain cleaning apparatus according to claim 9, wherein said terminal discharge member comprises a generally, conically-shaped terminal end portion.

* * * * *